US008167455B2

(12) United States Patent
Hsu

(10) Patent No.: US 8,167,455 B2
(45) Date of Patent: May 1, 2012

(54) LED LAMP HAVING A LARGER LIGHTING ANGLE

(75) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 104 days.

(21) Appl. No.: 12/731,377

(22) Filed: Mar. 25, 2010

(65) Prior Publication Data

US 2011/0110093 A1 May 12, 2011

(30) Foreign Application Priority Data

Nov. 10, 2009 (CN) ..... 2009 2 0262411 U

(51) Int. Cl.
*F21V 33/00* (2006.01)

(52) U.S. Cl. ..... 362/249.02; 362/256; 362/311.01; 362/329

(58) Field of Classification Search ..... 362/235, 362/249.01, 249.02, 255, 256, 308, 309, 362/311.01, 326, 329–340, 410, 555, 800
See application file for complete search history.

(56) References Cited

U.S. PATENT DOCUMENTS 6,361,192 B1 * 3/2002 Fussell et al. ..... 362/331
7,224,537 B2 * 5/2007 Choi ..... 359/707
7,441,930 B2 * 10/2008 Lin ..... 362/410
7,621,657 B2 * 11/2009 Ohkawa ..... 362/311.01
7,625,102 B2 * 12/2009 Koike et al. ..... 362/277
7,658,515 B2 * 2/2010 Park et al. ..... 362/311.02
7,901,108 B2 * 3/2011 Kabuki et al. ..... 362/235
7,922,367 B2 * 4/2011 Liu ..... 362/308
2005/0001537 A1 * 1/2005 West et al. ..... 313/500
2005/0201118 A1 * 9/2005 Godo ..... 362/555
2006/0044806 A1 * 3/2006 Abramov et al. ..... 362/337
2008/0285273 A1 * 11/2008 Liu et al. ..... 362/240

* cited by examiner

*Primary Examiner* — Hargobind S Sawhney
(74) *Attorney, Agent, or Firm* — Alan Kamrath; Kamrath IP Lawfirm, PA

(57) ABSTRACT

An LED lamp includes a lamp shade, an optical lens mounted in the lamp shade, and an LED module mounted in the lamp shade. Thus, the optical lens has a curved surface with different curvatures to reflect and refract the light beams of the LED module in different angles and directions so that after the light beams of the LED module pass through and emerge from the optical lens, the light beams of the LED module are scattered and diverged in different angles and directions from the optical lens and are distributed on the optical lens evenly and smoothly such that the LED module has a larger lighting angle so as to enhance the lighting effect and the aesthetic quality of the LED lamp.

16 Claims, 5 Drawing Sheets

LED LAMP HAVING A LARGER LIGHTING ANGLE

BACKGROUND OF THE INVENTION

1. Field of the Invention

The present invention relates to a lamp and, more particularly, to an LED (light emitting diode) lamp.

2. Description of the Related Art

A conventional LED lamp 8 in accordance with the prior art shown in FIG. 1 comprises a transparent lamp shade 80 and an LED module 82 mounted in the lamp shade 80 and having at least one light emitting member 84 emitting a plurality light beams 86 outwardly from the lamp shade 80. Thus, the LED lamp 8 provides a lighting effect by the light emitting member 84 of the LED module 82. However, the light emitting member 84 of the LED module 82 has a smaller lighting angle (the maximum lighting angle is about 120 degrees), thereby decreasing the lighting effect and the aesthetic quality of the conventional LED lamp 8.

BRIEF SUMMARY OF THE INVENTION

In accordance with the present invention, there is provided an LED lamp, comprising a lamp shade, an optical lens mounted in the lamp shade, and an LED module mounted in the lamp shade and emitting a plurality light beams which pass through the optical lens and are reflected and refracted by the optical lens.

Preferably, the optical lens has a curved surface with different curvatures.

Preferably, the optical lens includes a rotation body mounted on the LED module.

Preferably, the optical lens has a substantially bowl shape.

Preferably, the optical lens further includes a mounting portion mounted on the rotation body and secured to the LED module to attach the rotation body to the LED module.

Preferably, the rotation body of the optical lens has a bottom formed with at least one cavity to receive at least one light emitting member of the LED module.

Preferably, the rotation body of the optical lens has a center line aligning with the light emitting member of the LED module.

Preferably, the cavity of the rotation body has a substantially semi-spherical shape.

Preferably, the cavity of the rotation body has a central point aligning with the light emitting member of the LED module and the center line of the rotation body so that the light beams of the LED module directly pass through the cavity into the rotation body to reduce an optical loss of the LED module.

Preferably, the rotation body of the optical lens has a top formed with an aperture aligning with and connected to the cavity.

Preferably, the mounting portion of the optical lens is disposed between the rotation body of the optical lens and the LED module.

Preferably, the rotation body of the optical lens reflects and refracts the light beams of the LED module so as to scatter and diverge the light beams of the LED module.

Preferably, the center line of the rotation body is perpendicular to the LED module.

Preferably, the optical lens is located above the LED module.

Preferably, the rotation body of the optical lens has a periphery consisting of multiple optical segments which have different shapes and are arranged symmetrically.

Preferably, the periphery of the rotation body of the optical lens has a substantially flower petal profile.

Preferably, the rotation body of the optical lens has a recessed upper surface provided with two convex portions which are arranged symmetrically about the center line of the rotation body.

Preferably, the rotation body of the optical lens has a recessed lower surface provided with a substantially semi-spherical concave portion whose center intersecting the center line of the rotation body.

Preferably, the rotation body of the optical lens has a peripheral wall provided with two convex portions which are arranged symmetrically about the center line of the rotation body.

The primary objective of the present invention is to provide an LED lamp having a larger lighting angle.

According to the primary objective of the present invention, the optical lens has a curved surface with different curvatures to reflect and refract the light beams of the LED module in different angles and directions so that after the light beams of the LED module pass through and emerge from the optical lens, the light beams of the LED module are scattered and diverged in different angles and directions from the optical lens and are distributed on the optical lens evenly and smoothly such that the LED module has a larger lighting angle so as to enhance the lighting effect and the aesthetic quality of the LED lamp.

According to another objective of the present invention, the cavity of the rotation body has a semi-spherical shape and has a central point aligning with the light emitting member of the LED module and the center line of the rotation body so that the light beams of the LED module directly pass through the cavity into the rotation body to reduce an optical loss of the LED module.

According to a further objective of the present invention, the center line of the rotation body aligns with the light emitting member of the LED module so that the light beams of the LED module are diffused toward different directions symmetrically.

According to a further objective of the present invention, the rotation body of the optical lens has a peripheral wall provided with two convex portions to provide proper reflecting and refracting angles so that the light beams of the LED module are distributed on the optical lens evenly and smoothly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
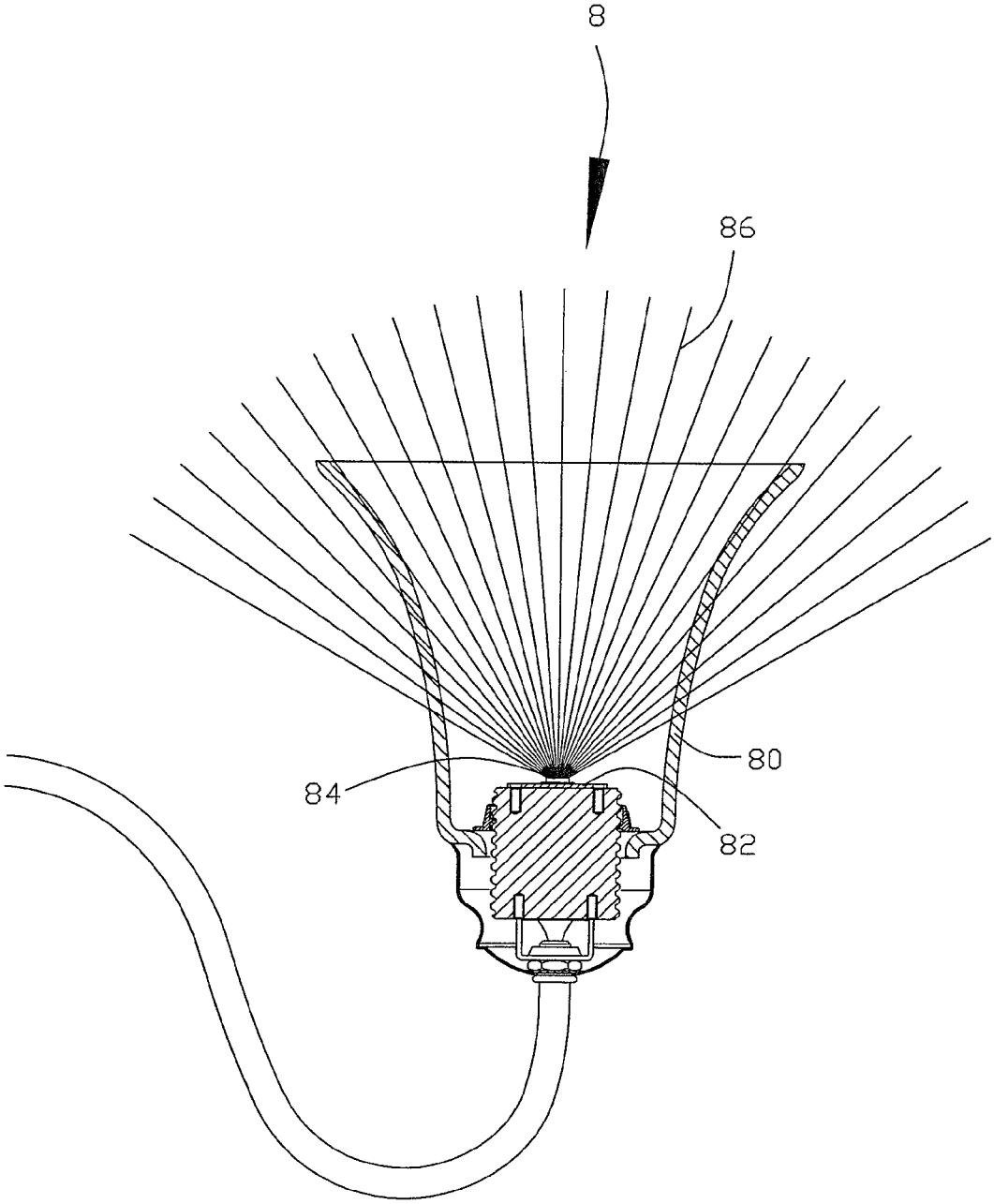
FIG. 1 PRIOR ART
FIG. 1 is a front cross-sectional view of a conventional LED lamp in accordance with the prior art.
Figure 2:
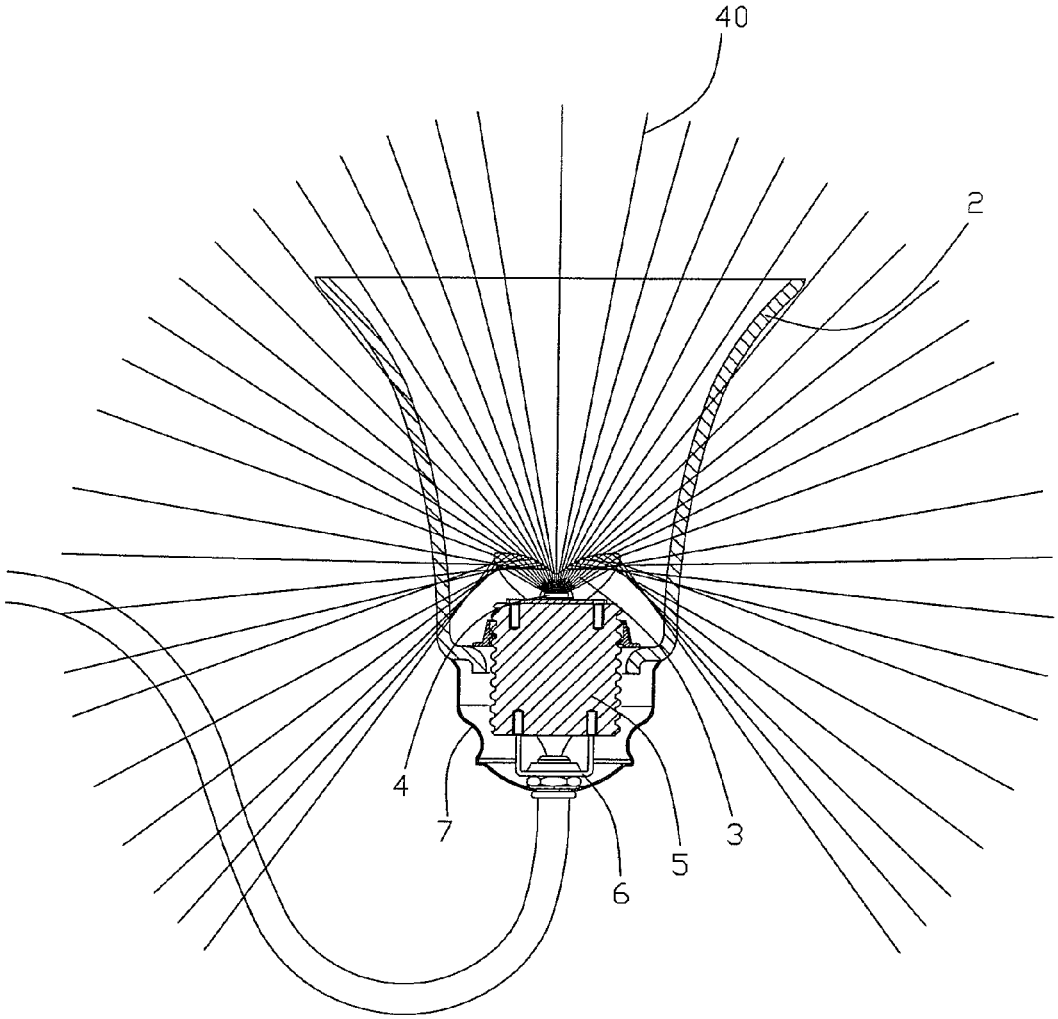
FIG. 2 is a front cross-sectional view of an LED lamp in accordance with the preferred embodiment of the present invention.
Figure 3:
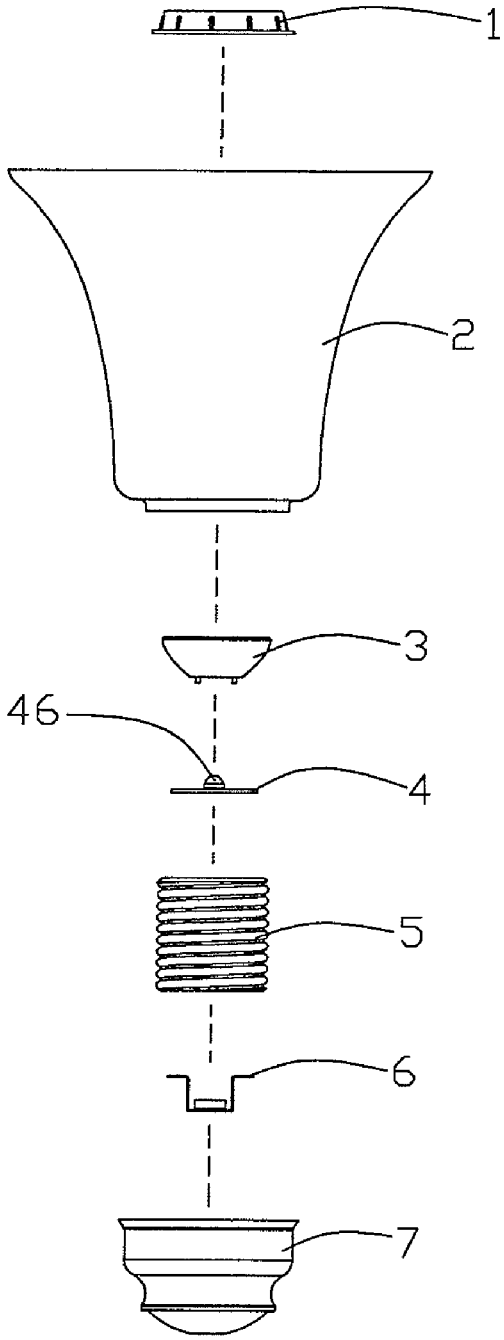
FIG. 3 is a front exploded view of the LED lamp as shown in FIG. 2.
Figure 4:
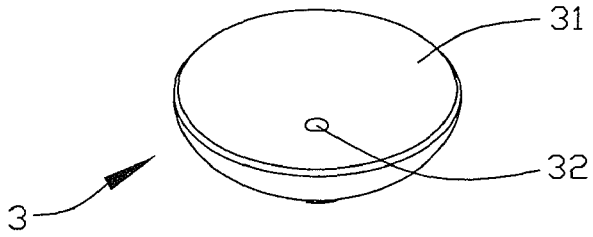
FIG. 4 is a perspective view of an optical lens of the LED lamp as shown in FIG. 3.
Figure 5:
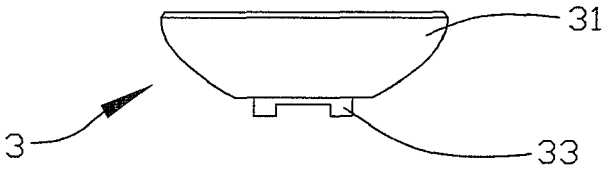
FIG. 5 is a front view of the optical lens of the LED lamp as shown in FIG. 4.
Figure 6:
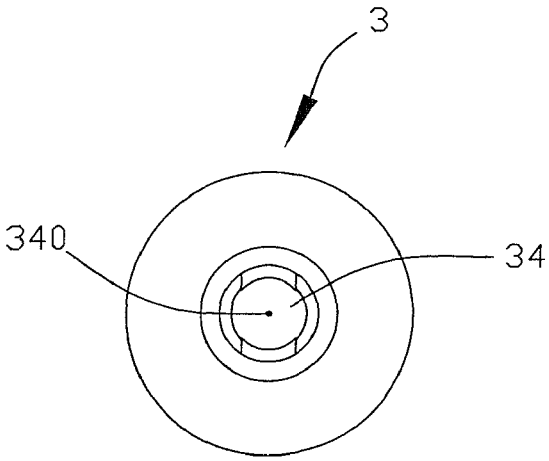
FIG. 6 is a bottom view of the optical lens of the LED lamp as shown in FIG. 4.
Figure 7:
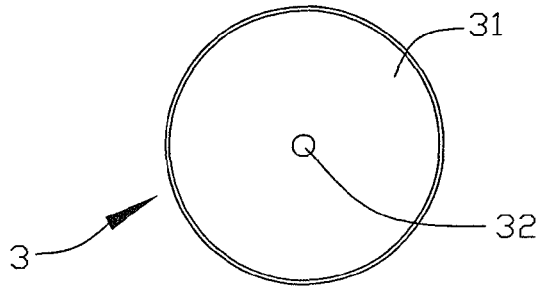
FIG. 7 is a top view of the optical lens of the LED lamp as shown in FIG. 4.
Figure 8:
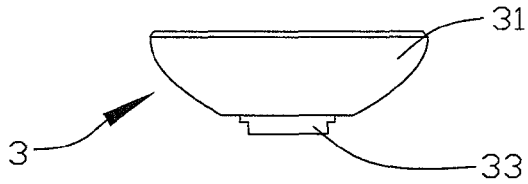
FIG. 8 is a side view of the optical lens of the LED lamp as shown in FIG. 4.

Referring to the drawings and initially to FIGS. 2 and 3, an LED (light emitting diode) lamp in accordance with the preferred embodiment of the present invention comprises a transparent lamp shade 2, an optical lens 3 mounted in the lamp shade 2, and an LED module 4 mounted in the lamp shade 2 and emitting a plurality light beams 40 which pass through the optical lens 3 and are reflected and refracted by the optical lens 3. The optical lens 3 is located above the LED module 4. The optical lens 3 is worked specifically so that the optical lens 3 has a curved surface with different curvatures.

The LED lamp further comprises a heatsink device 5 mounted on the bottom of the lamp shade 2 and abutting the LED module 4 to provide a heatsink effect to the LED module 4, a connector 7 connected with the bottom of the lamp shade 2 to receive the heatsink device 5, a support bracket 6 mounted between the heatsink device 5 and the connector 7 to support the heatsink device 5, and a retaining ring 1 mounted in the lamp shade 2 to fix the LED module 4.

In practice, when the light beams 40 of the LED module 4 pass through the optical lens 3, the light beams 40 of the LED module 4 are reflected and refracted by the optical lens 3. At this time, the optical lens 3 has different curvatures, so that the light beams 40 of the LED module 4 have different incident angles on the optical lens 3 and have different reflection and refraction angles on the optical lens 3. In such a manner, after the light beams 40 of the LED module 4 pass through and emerge from the optical lens 3, the light beams 40 of the LED module 4 are scattered and diverged in different angles from the optical lens 3 so that the LED module 4 has a larger lighting angle so as to enhance the lighting effect and the aesthetic quality of the LED lamp.

Referring to FIGS. 4-9 with reference to FIGS. 2 and 3, the optical lens 3 includes a rotation body 31 mounted on the LED module 4 and a mounting portion 33 mounted on the rotation body 31 and secured to the LED module 4 to attach the rotation body 31 to the LED module 4. The optical lens 3 has a substantially bowl shape. The mounting portion 33 of the optical lens 3 is disposed between the rotation body 31 of the optical lens 3 and the LED module 4.

The rotation body 31 of the optical lens 3 is used to reflect and refract the light beams 40 of the LED module 4 so as to scatter and diverge the light beams 40 of the LED module 4. The rotation body 31 of the optical lens 3 has a bottom formed with at least one cavity 34 to receive at least one light emitting member 46 of the LED module 4 and has a top formed with an aperture 32 aligning with and connected to the cavity 34. The rotation body 31 of the optical lens 3 has a center line 310 aligning with the light emitting member 46 of the LED module 4. The center line 310 of the rotation body 31 is perpendicular to the LED module 4. The cavity 34 of the rotation body 31 has a substantially semi-spherical shape and has a central point 340 aligning with the light emitting member 46 of the LED module 4 and the center line 310 of the rotation body 31 so that the light beams 40 of the LED module 4 directly pass through the cavity 34 into the rotation body 31 to reduce an optical loss of the LED module 4.

Figure 9:
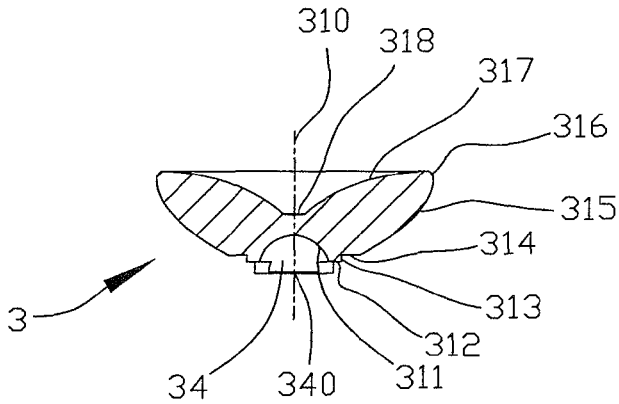
FIG. 9 is a front cross-sectional view of the optical lens of the LED lamp as shown in FIG. 4.

As shown in FIG. 9, the rotation body 31 of the optical lens 3 has a periphery consisting of multiple optical segments 311, 312, 313, 314, 315, 316, 317 and 318 which have different shapes and are arranged symmetrically to form a substantially flower petal profile. The rotation body 31 of the optical lens 3 has a recessed upper surface provided with two convex portions 317 which are arranged symmetrically about the center line 310 of the rotation body 31. The rotation body 31 of the optical lens 3 has a recessed lower surface provided with a substantially semi-spherical concave portion 311 whose center intersecting the center line 310 of the rotation body 31. The rotation body 31 of the optical lens 3 has a peripheral wall provided with two convex portions 315 which are arranged symmetrically about the center line 310 of the rotation body 31.

Accordingly, the optical lens 3 has a curved surface with different curvatures to reflect and refract the light beams 40 of the LED module 4 in different angles and directions so that after the light beams 40 of the LED module 4 pass through and emerge from the optical lens 3, the light beams 40 of the LED module 4 are scattered and diverged in different angles and directions from the optical lens 3 and are distributed on the optical lens 3 evenly and smoothly such that the LED module 4 has a larger lighting angle so as to enhance the lighting effect and the aesthetic quality of the LED lamp. In addition, the cavity 34 of the rotation body 31 has a semi-spherical shape and has a central point 340 aligning with the light emitting member 46 of the LED module 4 and the center line 310 of the rotation body 31 so that the light beams 40 of the LED module 4 directly pass through the cavity 34 into the rotation body 31 to reduce an optical loss of the LED module 4. Further, the center line 310 of the rotation body 31 aligns with the light emitting member 46 of the LED module 4 so that the light beams 40 of the LED module 4 are diffused toward different directions symmetrically. Further, the rotation body 31 of the optical lens 3 has a peripheral wall provided with two convex portions 315 to provide proper reflecting and refracting angles so that the light beams 40 of the LED module 4 are distributed on the optical lens 3 evenly and smoothly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An LED (light emitting diode) lamp, comprising:

a lamp shade;

an optical lens mounted in the lamp shade; and an LED module mounted in the lamp shade and emitting a plurality light beams which pass through the optical lens and are reflected and refracted by the optical lens;

wherein the optical lens includes a rotation body mounted on the LED module;

the optical lens further includes a mounting portion mounted on the rotation body and secured to the LED module to attach the rotation body to the LED module.

2. The LED lamp of claim 1, wherein the optical lens has a curved surface with different curvatures.

3. The LED lamp of claim 1, wherein the optical lens has a substantially bowl shape.

4. The LED lamp of claim 1, wherein the mounting portion of the optical lens is disposed between the rotation body of the optical lens and the LED module.

5. The LED lamp of claim 1, wherein the rotation body of the optical lens reflects and refracts the light beams of the LED module so as to scatter and diverge the light beams of the LED module.

6. The LED lamp of claim 1, wherein the optical lens is located above the LED module.

7. The LED lamp of claim 1, wherein the rotation body of the optical lens has a periphery consisting of multiple optical segments which have different shapes and are arranged symmetrically.

8. The LED lamp of claim 7, wherein the periphery of the rotation body of the optical lens has a substantially flower petal profile.

9. An LED (light emitting diode) lamp, comprising:

a lamp shade;

an optical lens mounted in the lamp shade; and an LED module mounted in the lamp shade and emitting a plurality light beams which pass through the optical lens and are reflected and refracted by the optical lens;

wherein the optical lens includes a rotation body mounted on the LED module;

the rotation body of the optical lens has a bottom formed with at least one cavity to receive at least one light emitting member of the LED module;

the rotation body of the optical lens has a top formed with an aperture aligning with and connected to the cavity.

10. The LED lamp of claim 9, wherein the rotation body of the optical lens has a center line aligning with the light emitting member of the LED module.

11. The LED lamp of claim 10, wherein the cavity of the rotation body has a substantially semi-spherical shape.

12. The LED lamp of claim 11, wherein the cavity of the rotation body has a central point aligning with the light emitting member of the LED module and the center line of the rotation body so that the light beams of the LED module directly pass through the cavity into the rotation body to reduce an optical loss of the LED module.

13. The LED lamp of claim 10, wherein the center line of the rotation body is perpendicular to the LED module.

14. The LED lamp of claim 10, wherein the rotation body of the optical lens has a recessed upper surface provided with two convex portions which are arranged symmetrically about the center line of the rotation body.

15. The LED lamp of claim 10, wherein the rotation body of the optical lens has a recessed lower surface provided with a substantially semi-spherical concave portion whose center intersecting the center line of the rotation body.

16. The LED lamp of claim 10, wherein the rotation body of the optical lens has a peripheral wall provided with two convex portions which are arranged symmetrically about the center line of the rotation body.

* * * * *